US006234765B1

(12) United States Patent
Deak

(10) Patent No.: US 6,234,765 B1
(45) Date of Patent: May 22, 2001

(54) ULTRASONIC PHASE PUMP

(75) Inventor: David Deak, Windham, NY (US)

(73) Assignee: Acme Widgets Research & Development, LLC, Boca Raton, FL (US)

( * ) Notice: Subject to any disclaimer, the term of this patent is extended or adjusted under 35 U.S.C. 154(b) by 0 days.

(21) Appl. No.: 09/258,387

(22) Filed: Feb. 26, 1999

(51) Int. Cl.[7] ..... F01B 23/08
(52) U.S. Cl. ..... 417/321
(58) Field of Search ..... 417/321, 322, 417/557, 53, 63

(56) References Cited

U.S. PATENT DOCUMENTS

| | | | | |
|---|---|---|---|---|
| 3,165,061 | * | 1/1965 | Smith et al. | 417/199.1 |
| 3,743,446 | * | 7/1973 | Mandrioan | 417/240 |
| 5,525,041 | * | 6/1996 | Deak | 417/63 |
| 6,010,316 | * | 1/2000 | Haller et al. | 417/322 |

* cited by examiner

*Primary Examiner*—Timothy S. Thorpe
*Assistant Examiner*—Trelita L Perry

(74) *Attorney, Agent, or Firm*—Stephen Roen

(57) ABSTRACT

A novel ultrasonic pump system using a series of cylindrical ultrasonic transducers comprising an inner cylinder component that propagates ultrasound in an omni-directional pattern emanating from the outer surface of the inner transducer component. Further, it also comprises an outer cylinder component that propagates ultrasound in an omni-directional pattern emanating from the inner surface of the outer transducer component. The inner cylinder component is placed parallel within the outer cylinder component, the outer cylinder component having a hollow inner cylindrical diameter greater than the outer cylindrical diameter of the inner hollow cylinder component. This allows for and equidistant hollow spacing parameter between the inner surface of the outer hollow cylinder, and the outer surface of the inner hollow cylinder component. As constructed in such a design feature therein lies the novel approach to propagating, by way of traveling acoustic pressure nodes and anti-nodes, a fluid down along the length of said cylinders. The invention teaches that with such a structure design, a pumping action will take place for the purpose of pumping fluids (liquids, vapors, and gases), and/or storing fluids for pressurization created in a special closed chamber comprising uni-directional pressure valves.

10 Claims, 12 Drawing Sheets

ULTRASONIC PHASE PUMP

FIELD OF THE INVENTION

This particular invention relates to fluid pumps and to ultrasonic pumps for fluid comprising a liquid, a liquid metal, a gas, or an aerosol medium and irrespective of the character or nature of the installation or system in which the pump is employed.

BACKGROUND OF THE INVENTION

The two categories of electro-mechanical pumps namely; force and compression pumps all require moving parts for proper operation and in some special way these parts are designed in relation to the amount of fluid to be pumped per unit time and further the overall volume of the physical pump design. Compression pumps known as positive displacement types are capable of generating great pressure, nevertheless requires many moving parts such as a piston, piston rod, crankshaft, and associated valve assemblies. Positive displacement constriction pumps are the safest; mainly because the pumped fluid never contacts an n environment different than its internal tubing. They are for this fact used widely in the medical and pharmaceutical sector where the prevention of contamination is a vital factor. Their major disadvantage lies in the possible crushing forces upon the material being pumped if the tubing constricts completely. The moving parts required therein wear out from the fatigue caused by continuous operation. There is for consideration the operation of prior art relating to sonic and ultrasonic pumps that feature as an embodiment using acoustic standing waves for their principle of operation. Specific references are to the patents of: Mandroian U.S. Pat. No. 3,743,446, Lucas U.S. Pat. No. 5,020,977, Lucas U.S. Pat. No. 5,263,341, and Deak U.S. Pat. No. 5,525,041. Referring to the Mandroian patent, it uses a source of sound from a fluctuating diaphragm or piezoelectric transducer that oscillates at a preselected frequency. The frequency of oscillation of the diaphragm piezoelectric transducer and the length of the pump chamber are configured together so that this arrangement forms a resonant cavity (chamber) where acoustic standing waves are established in the fluids which allows for a pressure node or antinode at the wall opposite the diaphragm piezoelectric transducer. A series of pressure nodes and antinodes are distributed along the length of the chamber, and the number of nodes and antinodes depending upon the length of the chamber and the frequency of vibration of the diaphragm piezoelectric transducer. Mandroian further describes that the entrance port for the fluid is located in the chamber at one of the pressure nodes and an exit port is located at one of the pressure antinodes. This embodiment requires that a resonant condition must be created before any pumping action occurs and further, it is critical to have the dimensions of the chamber such that the entrance and exit ports are precisely on the nodes and antinodes for proper operation. This proper operation relies heavily on frequency resonant conditions within the chamber; if for any reason there is a frequency shift, then the efficiency of operation is decreased.

Furthermore if there is any alteration of the chamber design dimensions, then it will result in an operational compromise.

In addition, since resonant standing waves are required for proper operation, and if these standing waves are changed for any reason and become traveling waves, either continuously or discontinuously or by slight variations around the vicinity of the ports due to phase shifting, then the operation is again compromised. Also where the waves emitted from the diaphragm or piezoelectric transducer become distorted for any reason. For example the wave changes from a sinusoidal wave to a complex wave with harmonics, then these harmonics have to be realized as having a recognizable effect upon the overall efficiency of the pump's operation. There are frequency limitations connected with some of the design features of such pumps that in many instances, these limitations as discussed below could limit the pump's various applications. In general, if the frequency chosen is to low, then size could be a problem, for it is required for efficient operation that within the chamber at least one wave length be given to the chamber dimension. Even if a half-wave length or a quarter-wave length is used as a physical dimension, there are certain disadvantages to these configurations relating to efficiency of operation. If the frequency utilized is too high, then the fluid could absorb the wave energy and attenuate the standing waves thus effecting overall operation. Accordingly this pump design does not provide efficient reliable pump operation under all conditions.

Referring to the Lucas patents, in both patents the theory of operation and so with the basic embodiment of both patents acknowledges the objective of using a gas in the resonant chamber (cavity) and not a liquid, the later of which is not achievable.

The compressors used in both Lucas' patents likewise utilize embodiments which uses standing waves of acoustic pressure for creating nodes which are periodic points of minimum pressure and antinodes which are periodic points of maximum pressure. The standing wave phenomenon of course requires a resonant state for proper operation so as with these compressors of the Lucas patents.

These compressors require that a very narrow resonant operational frequency range be utilized by way of specific electronic control circuitry. This control circuitry includes microprocessor controlled phase locked loops to insure frequency stability, thus adding to the complexity of the design. Such control circuitry is necessary for such a complex compressor system used for refrigeration.

The essence of Lucas' compressors, require the creation of a standing wave within a resonant chamber or cavity, and further attempting to maintain the standing wave with its fixed periodic nodes and antinodes of pressure. These nodes and antinodes are required to be precisely located at the entrance and exit fluid ports. This is done for the purpose of moving a gaseous refrigerant one way into a heat exchanger, where the excess heat generated from compression is carried off and the gaseous refrigerant is thereby cooled to a liquid phase. This cooled liquid is then passed through a volume that contains a number of ingredients to be cooled—such as food, etc. After the heat of the food or whatever, is passed to the liquid, it (the liquid) heats up and expands into the gaseous phase once more; only then to re-enter the resonant chamber of the compressor to begin the cycle all over again. In order to accomplish this task the internal mechanism of the compressor requires a longitudinal standing wave and that such a wave must be transverse to the exit and entrance ports. This mechanism is further established by action of streaming effecting the overall efficiency of such compressors by taking away energy from the wave. This streaming effect occurs when the very same pressure differentials that allow for transverse gaseous flow between exit and entrance ports, are of sufficient amplitude to cause a gaseous flow between the nodes and antinodes within the resonant chamber. This results in a continuous forth and back gaseous flow between the nodes and antinodes and sets up net flow impedance (a complex restriction to fluid flow) to the main flow to the port of ports. Streaming is similar to hydrodynamic eddy currents in fluids or electrical eddy currents in electrical transformers, etc. Decreased efficiency in overall operation is a result of such effect. Since the internal mechanism of these compressors is a longitudinal standing wave and that this wave is transverse to the exit and entrance ports. Accordingly the operation of the compressors is dependent upon the transverse or shear wave component of the standing wave. It is the transverse component, which allows for the initialization of the gaseous flow into the exit port, by means of a wave gradient from the entrance to the exit ports. Another feature of the compressors of Lucas' patents is the use of one or more ultrasonic drivers, which emit periodic ultrasonic energy, which may or may not be linear in nature. It is stated that the frequency of the transducer is above the standing wave frequency. It is then asserted that the energy is demodulated into pulses of complex waves, and that this is accomplished by the higher frequency components being attenuated by the gaseous environment. What is left then, is a pulsed complex wave with lower frequency components; some of which fall into the frequency range of the standing wave frequency and add energy thereto.

Additionally, the Lucas patents states that an ultrasonic transducer can be used in a non resonant pulsed or modulated mode, "non resonant mode" meaning that the frequency of the transducer is not equal to the frequency of the standing acoustical wave. In this pulsed or non-resonant mode, several items need further clarification: the transducer operates at its resonant mode and "that" mode is much higher than the standing wave frequency by design. The transducer is switched on and off to create a succession of short pulses; each pulse consists of a short train of high frequency oscillations. The high frequency components of this pulse train are absorbed or attenuated by the gaseous medium, and the lower frequency components falling within the range of the standing wave frequency will provide the necessary mode of operation. This is in effect overdrives the transducer crystal, creating nonlinear effects and complex waves leading to Fourier components of many frequencies, some of these being that of the standing wave frequency.

It is also suggested that a multiplicity of transducers be placed in contact at the nodes and antinodes, as such placements would allow energy to be added to the standing wave at various points. No doubt, energy would be added, moreover the energy coefficient of transducers is less than unity. The overall effect is like placing a group of transducers in parallel, their energy minus the losses are additive, therefore the same could be accomplished by using one transducer comparable in energy to all of their additive energies.

In view of the above discussion, the following points can be assessed with regard to the devices disclosed by the Mandroian and Lucas art patents:

1. Acoustic standing waves are the primary mode of operation of the prior art. Furthermore the standing waves are increased to their maximum value (taking into consideration system losses) after the generation of a traveling wave from a transducer or other source of acoustic energy. Further, this maximum value assigned to the standing wave is sustained by the constant acoustic energy injected into the system trough the transducer element.

2. A gaseous fluid is the medium of choice for the compressors of Lucas' in order to function properly as a refrigeration compressor.

3. The actual gaseous fluid flow is transverse to the acoustic standing wavefront.

4. Precise geometry of the chamber is essential for successful operation requiring a resonant mode for the chamber; and additional electronic control measures are required to provide frequency compensation circuitry; such as phase locked loops that adjusts for frequency drift above and below the resonant mode of the chamber.

5. The Lucas compressors can utilize a multiplicity of acoustic energy sources situated at any one or all of the acoustic generated pressure nodes and antinodes, for the purpose of feeding additional energy at these points to increase the overall system efficiency.

The prior Deak pump provides an optional ultrasonic transducer arrangement using either a single frequency range or a broadband frequency range using a special design configured transducer, which provide pumping action not requiring a resonant pump chamber, thereby eliminating numerous special arrangements inherent with such resonant pump designs.

OBJECTS AND SUMMARY OF THE INVENTION

It is therefore an object of the invention to provide an ultrasonic pump with no moving parts which makes use of electronically phase shifting a series of continuous standing waves of ultrasonic sound pressure whose direction of travel propagates down the length of the space volume existing between the inner and outer parallel cylinders.

It is a further object of the invention to provide a method of establishing a standing wave of acoustic pressure between the inner surface of an outer cylinder type ultrasonic transducer and the outer surface of the inner cylindrical type ultrasonic transducer.

It is a further object of the invention to provide two or more hollow cylindrical type ultrasonic transducers that are used in a parallel configuration whereby the cylindrical transducers are of different size, so as one is placed parallel within the larger diameter hollow cylindrical transducer.

It is a further object of the invention to provide a pump that is can pump fluids, which are totally isolated from any external contact, thus eliminating any concern for contamination of the fluid medium in question.

It is a further object of the invention to provide two or more hollow cylindrical type ultrasonic transducers that are used in a parallel configuration whereby the cylindrical transducers are of different size. So as one is placed parallel within the larger diameter hollow cylindrical transducer so as to provide a space volume or a multiplicity of space volumes for creating a complex pump with bi-directional or multidirectional fluid flow.

It is a further object of the invention to provide a pump with hollow ultrasonic transducer which can operate at the same frequency of a multiplicity of frequencies for producing complex pumping flow rates and control of it.

It is a further object of the invention to provide a pump storage chamber and one end of the parallel hollow ultrasonic transducer cylinders in order to store fluids or to compress gases.

It is a further object of the invention to provide a pump with a unidirectional input valve or a bi-directional input valve for fluid entry or exit.

It is a further object of the invention to provide a pump with a unidirectional output valve or a bi-directional output valve for fluid exit or entry.

In accordance with the broadest embodiment of the present invention, an ultrasonic pump is provided which comprises two or more hollow cylindrical tube type ultrasonic transducers with a fluid input valve and an output valve or storage chamber. The pump receives fluids from the input port and once it is entered it is moved along with the traveling standing wave of acoustic pressure that is established within the space volume of the two hollow cylindrical transducers. Once the fluid reaches the other end it exits through the output port, or it can be stored or compressed for a multiplicity of applications including compressing gases or atomizing vapors.

BRIEF DESCRIPTION OF THE DRAWING

These and other features of the present invention will further understood by reading the following Detailed Description, taken together with the Drawing figures, wherein.

DETAILED DESCRIPTION OF THE INVENTION

Theory of Operation

Consider a linear chain of identical atoms of mass M spaced at a distance $\alpha$. The lattice constant connected by invisible Hook's law springs. As considered for simplicity is longitudinal deformations; which is atomic displacement parallel to the chain.

Now by definition:

Un=The displacement of atom n from its equilibrium position.

Un−1=The displacement of atom n−1 from its equilibrium position.

Un+1=The displacement of atom n+1 from its equilibrium position.

An atom's displacement and the displacement of its nearest neighbors will give the force F on atom n as:
Equation 1

$$F_n=\beta(U_{n+1}-2U_n+U_{n-1})$$

The equation of motion is:

$$M\frac{\partial^2 U_n}{\partial^2 t}=\beta(U_{n+1}-2U_n+U_{n-1}) \quad \text{Equation 2}$$

Where β is a spring constant.

Equation 2 is not a wave equation, but assume a traveling wave or a traveling standing wave solution as:
Equation 3

$$U_n=U_{n0}\exp[i(kna)\pm\overline{w}t]$$

If Un0=Uo=since if it is a wave, it has to have a definite amplitude.

By substituting this wave solution into the equation of motion the phonon's dispersion relation for linear monatomic chain results as:

$$\varpi=\pm\sqrt{\frac{4\beta}{M}}\sin\frac{ka}{2} \quad \text{Equation 4}$$

Figure 1:
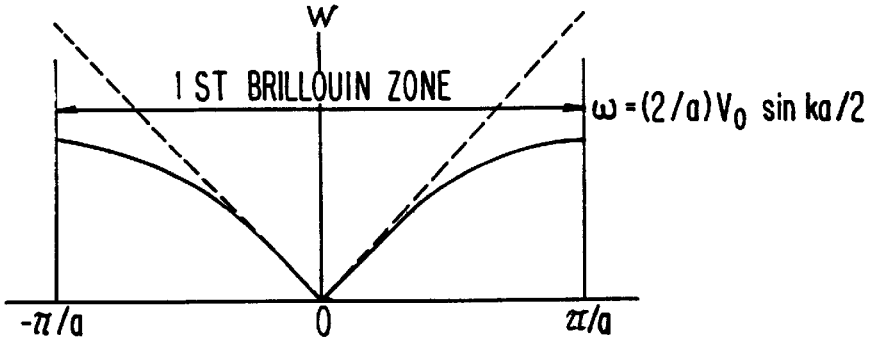
FIG. 1 is a mathematical plot of a Brillouin primary zone of phonon activity; (i.e.) motion of the phonon's dispersion relation for linear monatomic chains.
Figure 2:
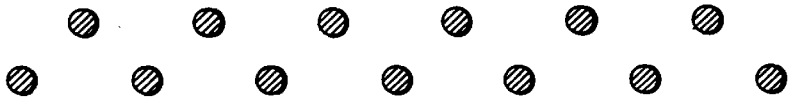
FIG. 2 is a graphical phonon illustration of transverse acoustical standing waves.
Figure 3:
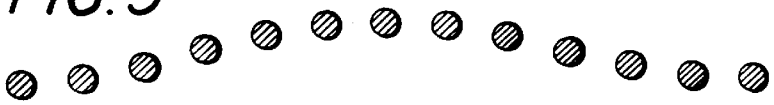
FIG. 3 is a graphical phonon illustration of long wavelength acoustic waves.

FIG. 1 shows the dispersion curve which is the periodicity of the function. For unit cell length α, the repeat period is 2π/α, which is equal to the unit cell length in the reciprocal lattice. Ergo, the useful information is contained in the waves with wave vectors lying between the limits:

$$-\frac{\pi}{a}<k<\frac{\pi}{a} \quad \text{Equation 5}$$

This range of wave vectors is called the first Brillouin zone. At the Brillouin zone boundaries, the nearest atoms of the chain vibrate in the opposite direction and the wave becomes a standing wave. As k approaches zero (the long-wavelength limit)

$$\sin x\rightarrow x \quad \text{Equation 6}$$

And we have $$\varpi=\sqrt{\frac{4\beta}{M}}\frac{ka}{2}=v_0k$$

Where $\upsilon_0$ is the phase velocity, which is equivalent to the velocity of a sound in the crystal. Phonons with a frequency which goes to zero in the limit of small k are known as acoustical phonons.

Figure 4:
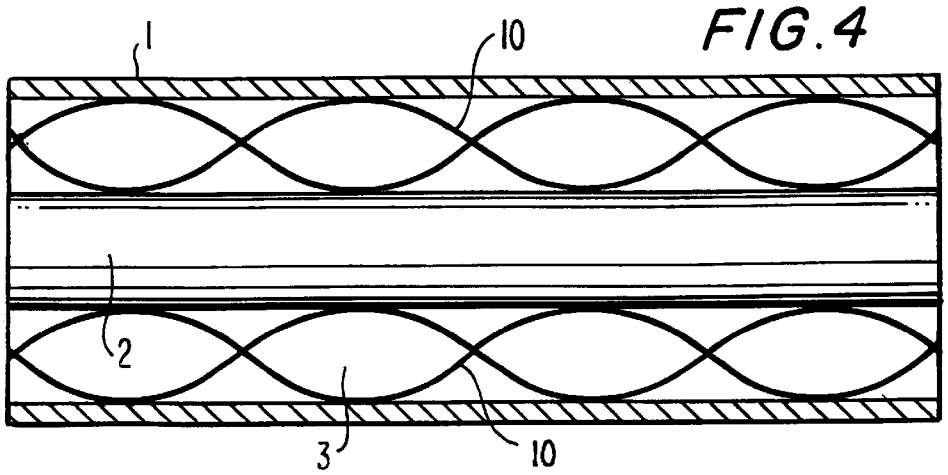
FIG. 4 is a partial cross-sectional view of a basic two element hollow cylinder ultrasonic phase pump configuration according to one embodiment of the present invention.

In FIG. 4, the broadest example of this present invention shows an outer ultrasonic cylindrical type transducer 1 which has it phonon emission source emanating from the inside surface of it's hollow cylindrical structure. Directly in parallel with and inserted within the outer ultrasonic cylindrical type transducer 1, is an inner ultrasonic cylindrical transducer 2, which has it's source of phonon emission on the outer surface of said transducer. The physical length of these transducers are such that they can be an integral number of wavelengths long so as to set up conditions for a whole number of standing waves based upon a certain frequency. These standing waves are established in the hollow section 3 between the outer ultrasonic cylindrical type transducer 1 and the inner ultrasonic cylindrical transducer 2. These outer and inner ultrasonic transducers are of a continuous type with a uniform piezoelectric surface through their intended emission source, but not limited to a continuous uniform surface area.

Figure 5:
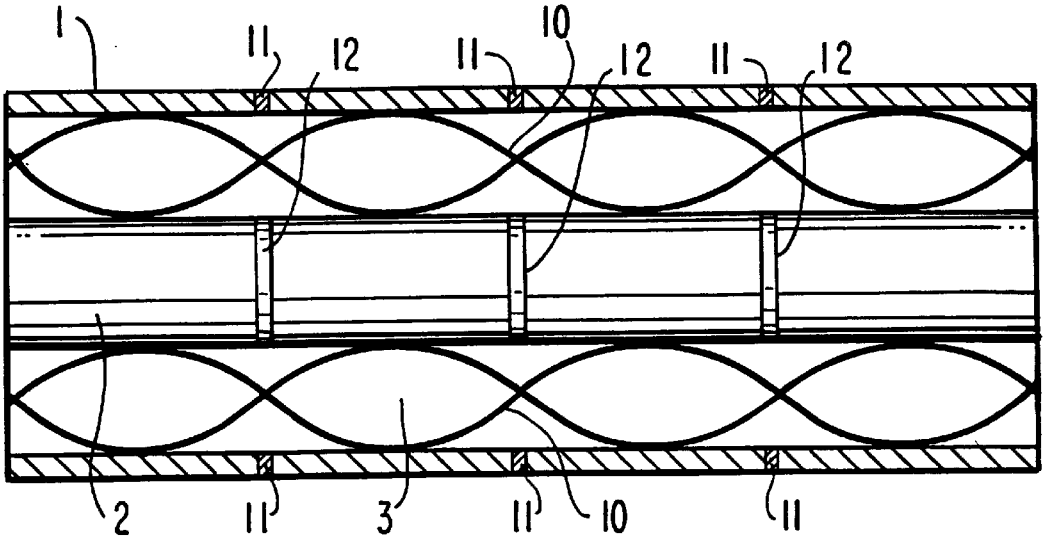
FIG. 5 is a partial cross-sectional view of a basic two element hollow cylinder ultrasonic phase pump configuration with a multiplicity of segmented transducer elements according to an alternate embodiment of the present invention.

Alternate embodiments comprise a series of isolated section of piezoelectric surface areas independent of each other and both electrically and mechanically isolated from each other to form an array of piezoelectric surface areas. This is illustrated in FIG. 5. Each section is selectively excited by a signal having relative phase displacement as provided by a signal generator and a phase shifter for each corresponding transducer section. These sections 2A, 2B, 2C, 2D . . . (etc.) are electrically and mechanically isolated while including a fluid seal therebetween to maintain integrity of the overall fluid chamber retaining fluid between the inner and outer transducers.

The areas of non-piezoelectric separators (isolation regions) for the outer transducer 1 are shown as item 11, and the non-piezoelectric separators (isolation regions) are shown as item 12. In the broadest sense, the simple form of the phase pump is shown in FIG. 4 where only one continuous section of outer 1 and inner 2 transducers are employed for operation. Electrical pulses are sent to excite the outer 1 and the inner 2 transducers so as to cause emission of phonons into the hollow region of said phase pump. There upon, a wavefront is set up in the fluid medium contained within the hollow region 3 of said phase pump. When standing waves of acoustic pressure are established in the hollow region 3, regions of nodes (minimum points) and antinodes (maximum points) appear. By changing the electrical phase relationship between the outer transducers 11 and the inner transducers 12, such as advancing or retarding the outer transducer excitation signal relative to the inner transducer excitation signal by as much as +/−90 degrees, movement of the fluid medium will take place and this movement will progress down along the hollow region 3.

Figure 6:
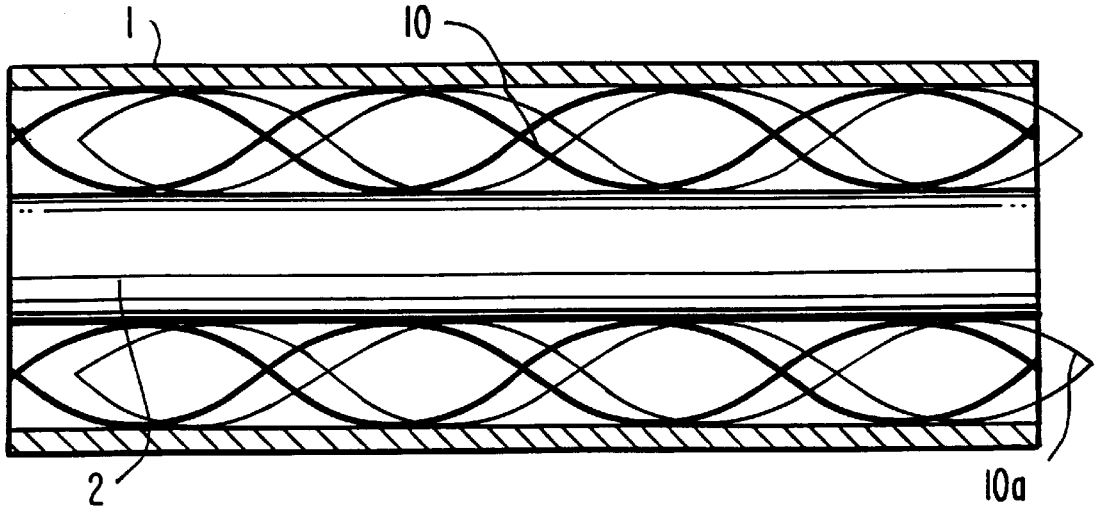
FIG. 6 is a partial cross-sectional view of a basic two element hollow cylinder ultrasonic phase pump configuration, showing the movement of standing acoustical waves set up between the two different transducer elements according to an alternate embodiment of the present invention.

FIG. 6 shows movement of the standing waves 10-*a* from left to right in the simplest form of the invention using only a single outer transducer 11 and a single inner transducer 12.

Figure 7:
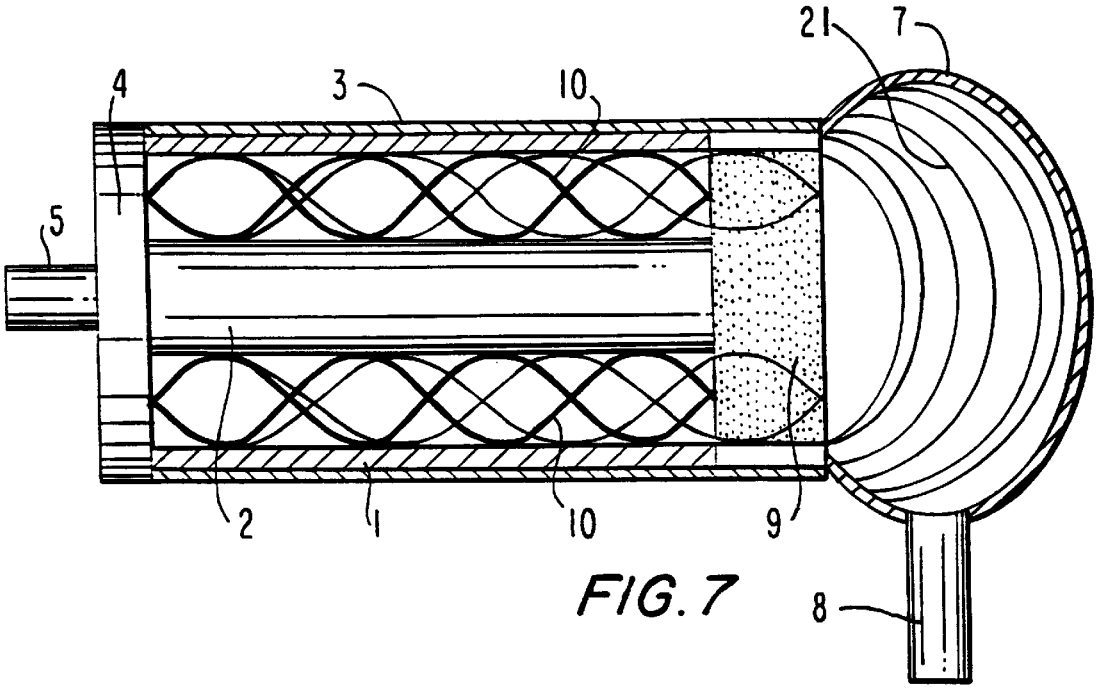
FIG. 7 is a partial cross-sectional view of a basic two element hollow cylinder ultrasonic phase pump configuration, showing the movement of standing acoustical waves set up between the two different transducer elements and including a storage area for pressure build up and with an output port according to an alternate embodiment of the present invention.

FIG. 7 shows in the broadest sense, the established standing waves that are created between inner transducer 2 and outer transducer 1 and by producing a varying phase relationship to the electrical signal applied to said transducers. The traveling standing waves, shift with applied momentum, and are stored through the porous region 9 which acts as a passive conveyance mechanism for the fluid to flow into the storage chamber 7. Where the fluid waves 11 are built up to such pressure that they eventually trigger the one-way threshold valve 8 to open and thus allow for fluid flow to occur. This action creates a partial vacuum in area 4, and a self-priming feature is seen as part of the total action of the pump.

Figure 8:
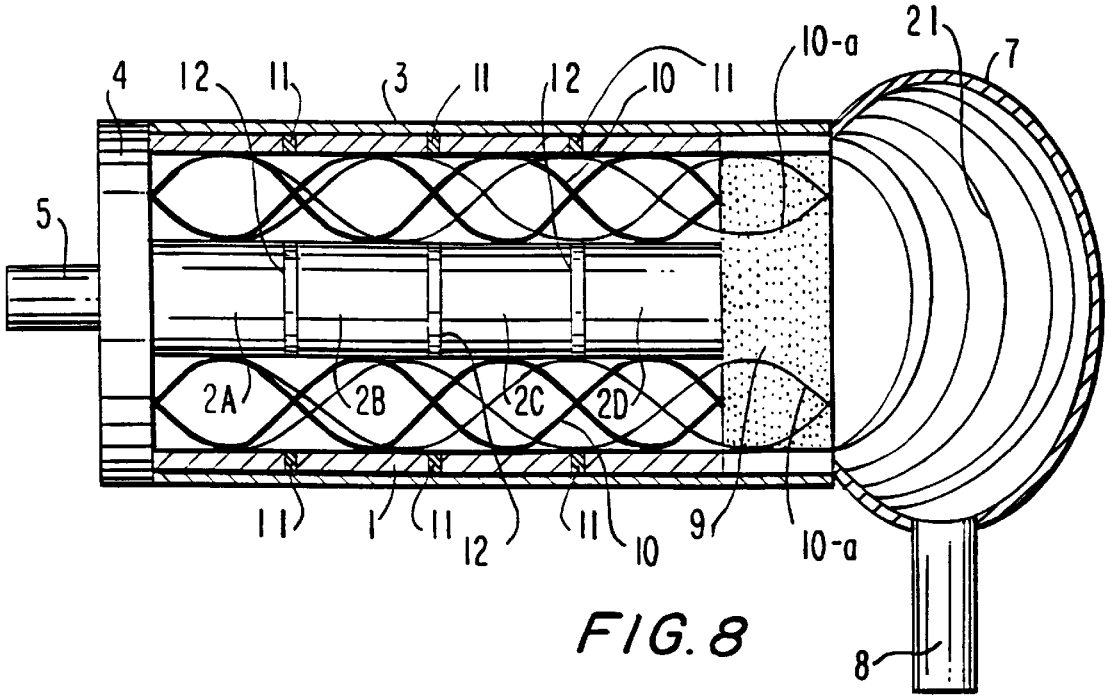
FIG. 8 is a partial cross-sectional view of a segmented hollow cylinder ultrasonic phase pump configuration, showing the movement of standing acoustical waves set up between the two different transducer elements, and a storage area for pressure build up and with an output port according to an alternate embodiment of the present invention.

In FIG. 8, the same action is described in a model that incorporates a multiplicity of inner 2 and outer 1 transducers. Where the inner 2 and outer 1 transducers are electrically and piezo-electrically isolated from one another by isolation segments 12 for the inner transducers 2 and by the isolation segments 11 for the outer transducers 1. In the same methodology, established standing waves that are created between inner transducer 2 and outer transducer 1 and by producing a varying phase relationship to the electrical signal applied to said transducers. The traveling standing waves, shift with applied momentum, and are stored through the porous region 9 which acts as a passive conveyance mechanism for the fluid to flow into the storage chamber 7. Where the fluid waves 11 are built up to such pressure that they eventually trigger the one-way threshold valve 8 to open and thus allow for fluid flow to occur. This action creates a partial vacuum in area 4, and a self-priming feature is seen as part of the total action of the pump.

Saser Option

Sonolumenescent Amplification by Stimulated Emission of Radiation

With increased radiation energy density, non linearity of the medium in the waveguide alters the radiation energy wave, thus creating radiation harmonics. These high frequency harmonic radiation components are propagated and absorbed within the medium and if the energy levels emitted from the dual waveguide transducer are of sufficient amplitude, cavitation will occur when the rarefactive acoustic pressure results in the formation of a vapor phase of the medium in the flow gradient.

Cavitation is the process of forming micro-bubbles in a liquid by generating intense ultrasound waves. When a cavity (gas or vapor bubble) is created and trapped in a fluid by an influentially strong ultrasound field, it undergoes nonlinear oscillations that can concentrate the average sound energy by over 12 orders of magnitude so as to create UV light (sonoluminescence). The history of sonoluminescence ("SL") covers more than five decades, and from previous research (2), sonoluminescence is well-established as a branch of physics. Sonoluminescence is a non-equilibrium phenomenon in which energy in a sound wave becomes highly concentrated so as to generate flashes of light in a liquid. These flashes comprise of over 105 photons and they are too fast to be resolved by the fastest photo-multiplier tubes available. Basic experiments show that when sonoluminescence is driven by a resonant sound field, the bursts can occur in a continuously repeating, regular fashion. These precise 'clock-like' emissions can continue for hours at drive frequencies ranging from sonic to ultrasonic. These bursts represent an amplification of energy by eleven orders of magnitude. During the rarefaction part of the acoustic cycle the bubble absorbs energy from the sound field and its radius expands from an ambient value Ro to a maximum value Rm. The compressional component of the imposed sound field causes the bubble to collapse in a runaway fashion (first anticipated by physicist Rayleigh about 1917). The resulting excitation (heating) of the bubble contents (surface) leads to the emission of a pulse of light as the bubble approaches a minimum radius Rc. This manifests as a 50 ps (picosecond) pulse width and peak power of 30 mW. Cavitation results from the dynamical Casimir effect, wherein dielectric media are accelerated and emit light. Experiments show that just before the event of maximum bubble radius is achieved, the implosion velocity exceeds Mach-1 relative to the gas (for an acoustic period of 37.7 ns, Mach-1 is reached about 10 ns (nanoseconds) before Rc; Rc=the collapse radius). The SL light is also emitted just prior to the minimum (about 5–10 ns prior to Rc); Rm is about 40 $\mu$m and Rc is about 4 $\mu$m.

Consider a bubble with radius Ro and in equilibrium with hydrostatic pressure Po at t=o, which will then expand isothermally in the first quarter of a period of the supersonic field. If the amplitude PA of the field is large enough, the radius of the bubble is known to expand and contract respectively around the complete pressure field cycle. The pressure field in area from Po−PA to Po+PA and the bubble contracts adiabaticaly with increasing pressure. Let Rm be a radius of the minimum bubble, when the gas filling the bubble achieves the maximum temperature Tmax.

Ones interest lies with the contraction phase of the bubble where it was numerically ascertained by many authors that the contractions occurs very rapidly around the end of the third quarter of a period of the supersonic field, when the pressure field is almost, Po+PA. Therefore one can describe the adiabatic contraction process by the several following equations;

$$(P_o + P_a)(V_{\max} + V_{\min}) = -\int_{V_{\min}}^{V_{\max}} PV. \qquad \text{Equation 7}$$

PV=a constant instead of directly solving the differential equation. After integrating, the maximum temperature and minimum radius is obtained as follows.

$$\frac{\partial^2}{\partial R^2} = -\frac{3}{2R}\left(\frac{\partial}{\partial R}\right)^2 + \frac{1}{\varsigma R}\left[\begin{array}{l}\left(P_0 + \frac{2\sigma}{R_0}\right)\left(\frac{R_0}{R}\right)^{3x} \\ -\frac{2\sigma}{R} - \frac{4\mu\frac{\partial}{\partial R}}{R} \\ -P_0 - P_0(t) \\ \cdot\cdot\end{array}\right]. \qquad \text{Equation 8}$$

$$Z \equiv \left(\frac{R_{\max}}{R_{\min}}\right)^3 \approx \left[(\gamma - 1)\frac{P + P_a}{P_{oo} + \frac{2\sigma}{R_o}}\left(\frac{R_{\max}}{R_o}\right)^3\right]^{\frac{1}{\gamma-1}} \qquad \text{Equation 9}$$

where Z is much greater than unity, and To is the initial temperature. An important realization is that this cavitation which represents a vapor phase of the fluid behaves as a very good reflector of acoustic energy and this produces the maximum momentum transfer to reflector of acoustic energy and this produces the maximum energy transfer to the pumped medium which is equal to twice the amount of the energy density. Therefore the generation of cavitation within the fluid is an essential component to be considered for "non-pump" operation.

Figure 9:
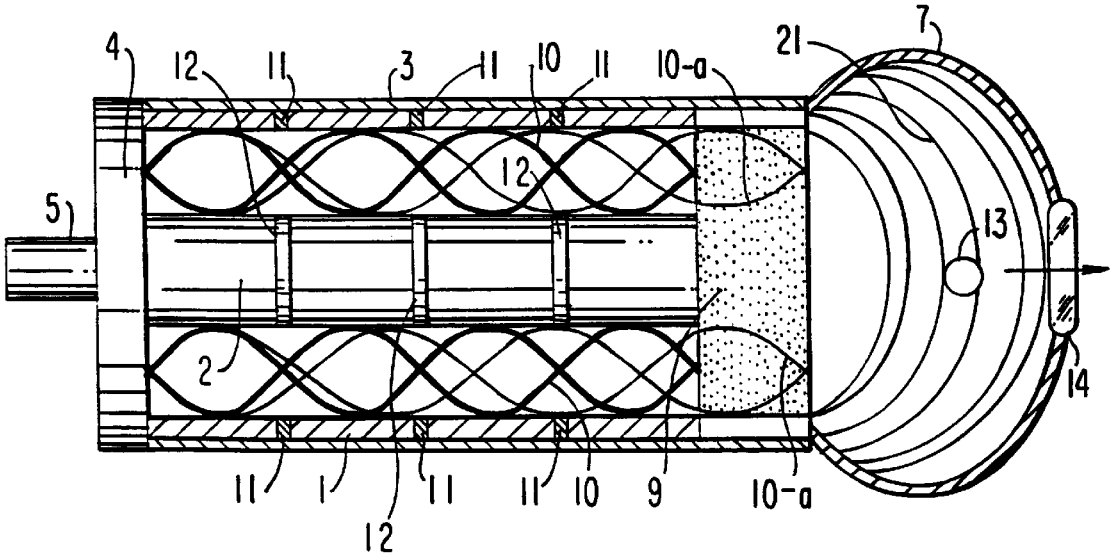
FIG. 9 is a partial cross-sectional view of a segmented hollow cylinder ultrasonic phase pump configuration, showing the movement of standing acoustical waves set up between the two different transducer elements, and a storage area for pressure build up and without an output port, but including a transparent quartz window, is for the generation of and transmission of sustained sonoluminescence, according to an alternate embodiment of the present invention.

In FIG. 9, the same action is described in a model that incorporates a multiplicity of inner 2 and outer 1 transducers. Where the inner 2 and outer 1 transducers are electrically and piezo-electrically isolated from one another by isolation segments 12 for the inner transducers 2 and by the isolation segments 11 for the outer transducers 1. In the same methodology, established standing waves that are created between inner transducer 2 and outer transducer 1 and by producing a varying phase relationship to the electrical signal applied to said transducers. The traveling standing waves, shift with applied momentum, and are stored through the porous region 9 which acts as a passive conveyance mechanism for the fluid to flow into the storage chamber 7. Where the fluid waves 21 are built up and stored, without fluid release, to such pressure that SONOLUMENSECENCE occurs within the cavity bubble 13.

The blue (SONOLUMENSECENT) light generated from the action of SONOLUMENSECENCE within the storage chamber 7 is emitted through the transparent quarts window 14.

Shock Waves

When intense ultrasound is applied to water, bubbles appear in the liquid. Among the properties they exhibit is sound radiation and emission of photons. In a controlled experiment, a single bubble alone may be driven stable in a standing ultrasound field. Here, intense light pulses of very short duration may be observed. Since this discovery experimental work on the so called single bubble sonoluminescence (SBSL) has been extensively carried out to explain the phenomenon and the interesting features it displays: The energy is focused by 12 orders of magnitude, the light pulses are of picosecond duration, the emitted light energy per pulse is in the MeV range, the blackbody like spectrum peaks in the ultraviolet. The interpulse synchronicity can be accurate on the picosecond scale or chaotic on the microsecond scale. Parameter studies have been done showing the region of stable SBSL lying on the boundary of a dissolution island. Advanced driving of the bubble is employed to increase the light output. Theoretical and numerical work has been done to explain SBSL but so far few basic assumptions of the different theories could be verified experimentally. An inner shock wave launched in the interior of the bubble upon collapse has theoretically been assumed to account for the observed short SBSL light pulse and its spectrum.

Figure 10:
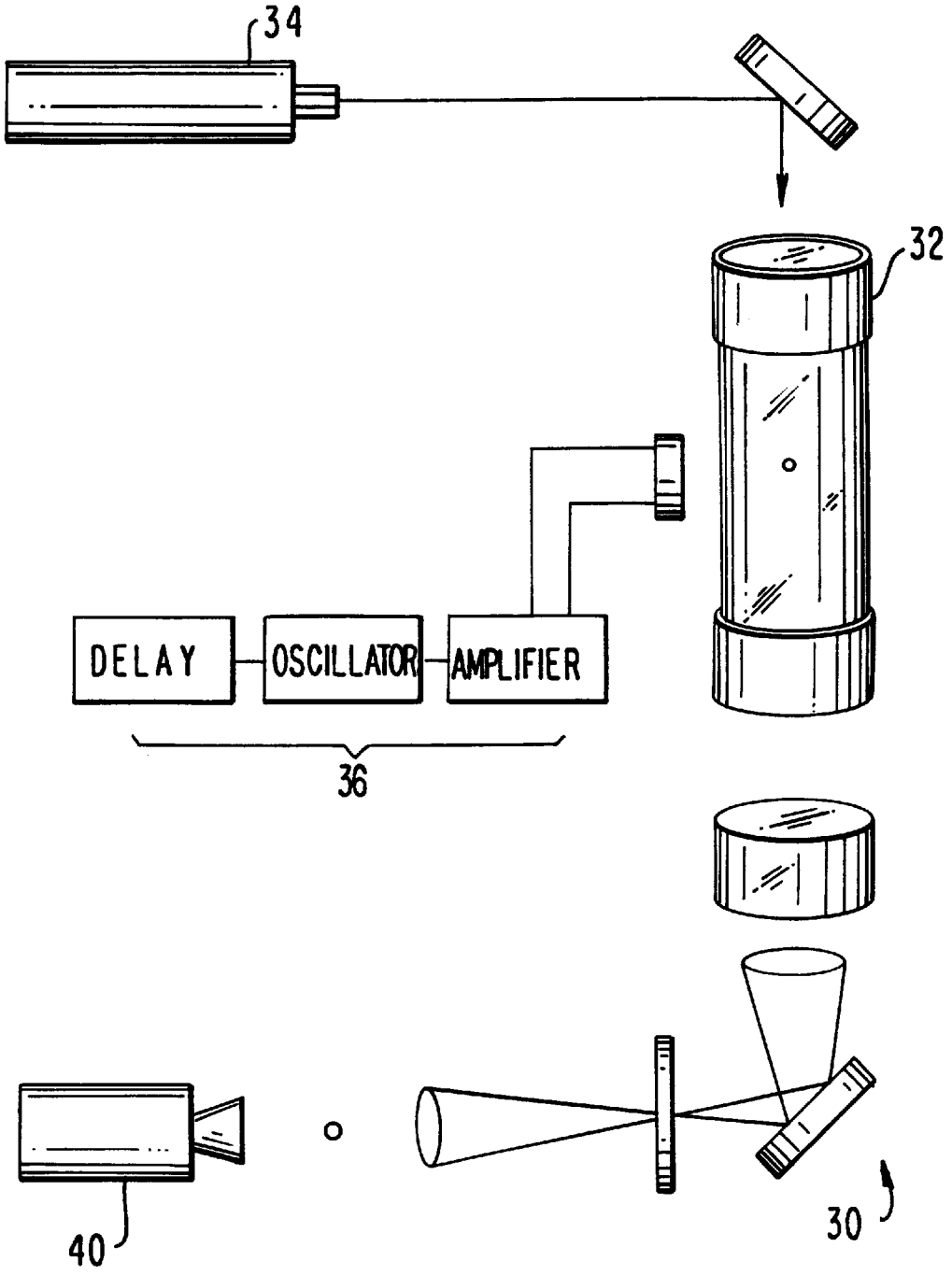
FIG. 10 is a block drawing of a prior art experimental set up procedure used by anyone steeped in the art to produce sonoluminescence for observation and data collection.

Prior experimental and numerical work in Germany by Joachim Holzfuss, Matthias Rugggeberg, and Andreas Billo, focuses on the observation of shock waves being emitted into the liquid at bubble collapse, and is incorporated by reference. The shock waves are visualized, the velocity of the front as it travels outwards is measured and the peak pressure of the shock is deduced. Effects appearing at unstable SBSL are analyzed. The experiments are consistent with numerical simulations. According to further alternate embodiments of the present invention, the structure of their experiment (FIG. 10) is incorporated within the structure of FIGS. 7, 8 or 9, wherein the shock waves are produced by the inner and outer transducers 1 and 2, respectively, and the laser energy is introduced into the fluid within the storage chamber 7. The standing ultrasound wave is produced in a cylindrical cell filled with water of ambient temperature, distilled and de-gassed to 10–40% of ambient gas pressure. The cell comprises of two piezo-ceramic cylinders connected by a glass tube of 2.9 cm radius (overall height, 12 cm). An optical glass plate closes the bottom, and the top remains open. The driving frequency is 23.5 kHz and the driving amplitude is approximately equal to 1.2 to 1.5 bars of pressure. A bubble is inserted into the liquid with a syringe. The oscillating bubble is illuminated from the top by a copper vapor laser 34 by light pulses of 7 ns duration (FWHM) followed by a low intensity tail of 30 ns. The wavelength is 511 nm. The repetition rate of one-half the driving frequency provided by exciting system 36, is adjusted via a controllable delay to accommodate locking to the driving signal at a preset phase.

Figure 11A:
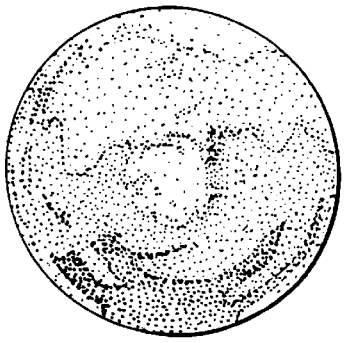
FIGS. 11A & 11B are perspective images of a shock wave emitted by a sonoluminescencing bubble a time t after collapse, and the reflection off the side walls of the cavity before collapse, respectively.
Figure 11B:
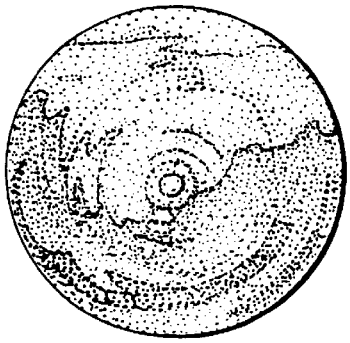

Because shock waves modulate the phase of the laser light, optical filtering is used to transform this information into intensity modulations. Therefore the bubble image is passed through a (magnifying) 4f spatial Fourier filter. Specifically, a dark-ground method is used that removes the zeroth order in the Fourier plane with a thin metal stick. Subsequently the image is picked up by a video camera 40 delivering 25 frames/s. The shutter opening time is 0.25 ms such that the average image of 2–3 shock waves is seen. Because of the stable repetitive bubble collapse a slow motion video of the oscillations and the shedding of shock waves is produced by slightly detuning the laser flash frequency. The images of the shock waves are digitized in a computer and their radius/time curves can be plotted. Because of their submicron size, sonoluminescing bubbles are hard to detect at collapse. But by recording the center of the shock wave the bubble position can be determined. FIG. 11 shows the images of shock waves at different times. The shock is emitted at the main collapse of the bubble. The shock front shows up as a circle FIG. 11*a* and no anisotropy is seen within the optical resolution limit of 1.5 microns, which indicates that the collapse is symmetric within that resolution limit. The front proceeds to the outer glass wall of the cylinder, reflects, and moves inward again. The reflected shock wave has a duration >40 ns and is distorted, presumably due to imperfections or misalignment of the glass wall. FIG. 11*b* shows the shock wave at the time it is refocused the most (3.54 microseconds before the next collapse). The main pressure peak seems to be approximately 700 microns away from the bubble at the lower end of a line structure. The refocused shock is sometimes powerful enough to kick the bubble through space a bit as it passes it. Weaker secondary reflections are also observable. At no time we could see a pressure pulse due to bubble rebounds. The duration of the shock pulse can be determined to be 10 ns (FWHM). As this is on the order of the optical pulse length of 7 ns, this value is an upper bound.

Figure 12:
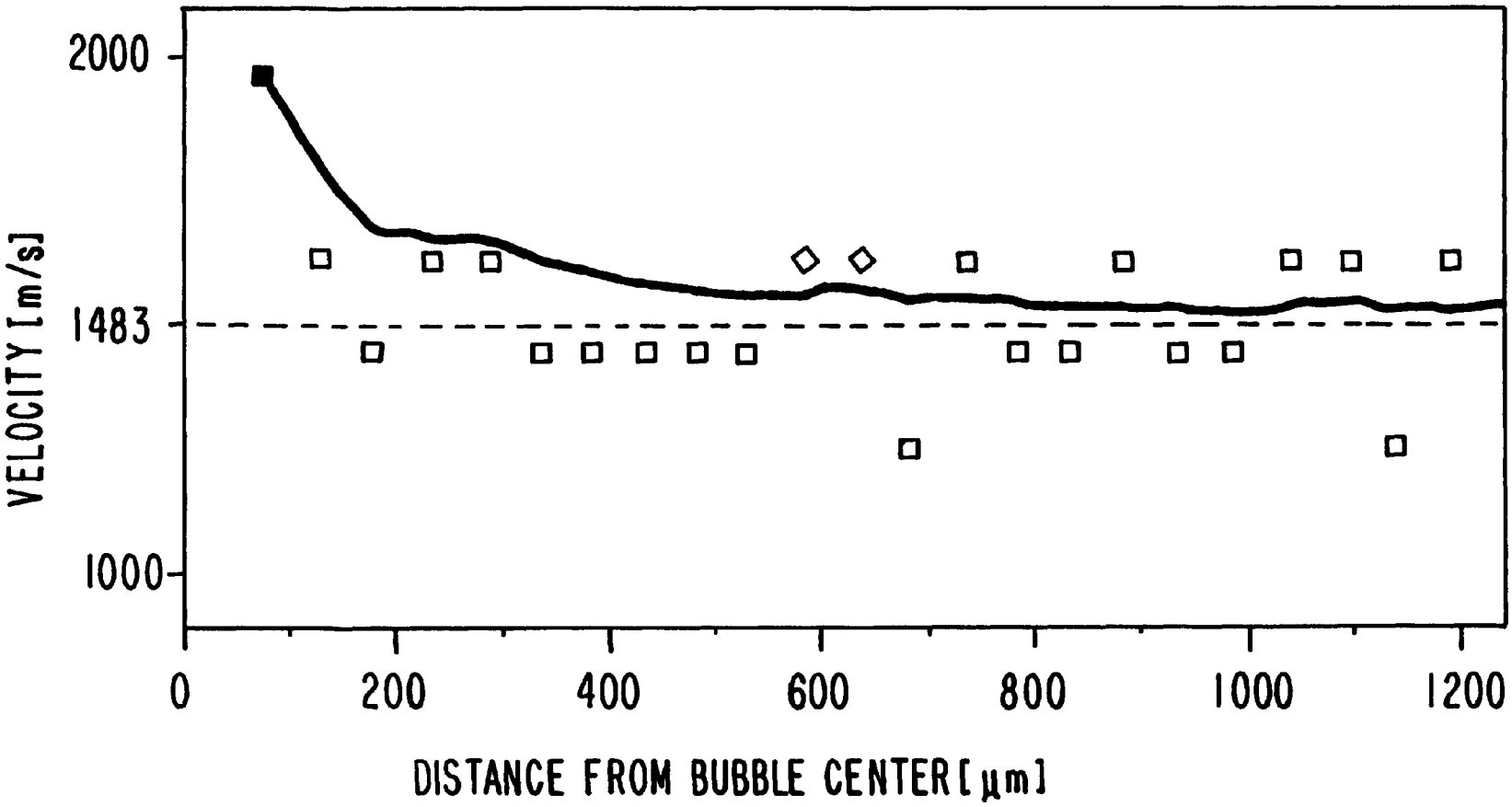
FIG. 12 is mathematical plot of average velocities of the shock wave.

From successive images the velocity of the shock front is calculated. FIG. 12 shows the average velocities as a function of distance from the bubble center. At very small distances (6–73 microns) an average value of the velocity is 2000 m/s is measured, at larger distances the velocity of the shock front is decreasing to the ambient sound speed. Because the velocity of the shock decreases rapidly, the instantaneous velocity may be well above 2000 m/s. The pressure p in the shock can be determined from its velocity v by a Rankine-Hugeniot relation and a state equation for water, namely, the Tait equation.

In FIG. 12, average velocities (34 nanoseconds) of the SBSL-shock wave from successive images as a function of the distance from the generation (circles). The solid line is the mean velocity extrapolated by averaging over all measurement points up to a respective distance r from the bubble center.

$$v = \frac{1}{\rho_0}\sqrt{\frac{p - p_0}{\rho_0^{-1} - \rho^{-1}}} \qquad \text{Equation 10}$$

and $$\frac{p + B}{p_0 + B} = \left\{\frac{\rho}{\rho_0}\right\}^n$$

ρ and p are the maximal density and pressure in the shock, $\rho_o$=998.2 kg/m and $\rho_o$=1 bar are the ambient density and pressure, n=7.025, B=3046 bars. Using Equation 9, the shock pressure can be calculated to be 500 bars. Numerical calculations have been carried out to further analyze the time dependence of the velocity and pressure of the shock front. The Gilmore model describing the radial motion of a bubble is used.

$$\left(1 - \frac{\dot{R}}{C}\right)R\ddot{R} + \frac{3}{2}\left(1 - \frac{\dot{R}}{3C}\right)\dot{R}^2 = \left(1 + \frac{\dot{R}}{C}\right)H + \left(1 - \frac{\dot{R}}{C}\right)\frac{R}{C}\frac{dH}{dL} \qquad \text{Equation 11}$$

$$C = c|_{r\sim R} = \sqrt{\frac{dp}{d\rho}}\bigg|_{r\sim R} = c_0\left(\frac{p(R_j\dot{R}) + B}{p_0 + B}\right)^{(n-1)/2n} \qquad \text{Equation 12}$$

$$p(R_j\dot{R}) = \left(p_0 + \frac{2\sigma}{R_0}\right)\left(\frac{R_0^3 - a^3}{R^3 - a^3}\right)^{\kappa} - \frac{2\sigma}{R} - \frac{4\mu}{R}\dot{R} \qquad \text{Equation 12A}$$

R is the bubble radius, C, ρ, and p are the speed of sound in the liquid, its density, and the pressure at the bubble wall, respectively.

$$H = \int^{p(R)} \rho^{-1} d\,p \qquad \text{Equation 12B}$$

is the enthalpy of the liquid. Parameters were set to $c_o$=1483 m/s, σ=0.0725 N/m, and $\mu$=0.001 Ns/m. α=R0/8.86 is a hard-core van der Waals-term and κ=5/3 the adiabatic exponent for argon. The pressure at infinity is $$p_x = p_0 + p_c \cos(2\pi f t) \qquad \text{Equation 13}$$

$p_c$ and f are the driving pressure and frequency.

The dynamics of the pressure pulse in the liquid is calculated by using the Kirkwood-Bethe hypothesis: the invariant quantity $$\Upsilon = R\left(H + \frac{1}{2}\dot{R}^2\right) \qquad \text{Equation 14}$$

propagates with the characteristic velocity c+u, the local sound plus particle velocity in the liquid. The outgoing characteristics are determined by $$\frac{d\,u}{d\,l} = \frac{1}{c-u}\left[(c+u)\frac{\Upsilon}{\tau^2} - \frac{2c^2u}{\tau}\right], \qquad \text{Equation 15, 16}$$

$$\frac{d\,p}{d\,l} = \frac{\rho_0}{\tau(c-u)}\left(\frac{p+B}{p_0+B}\right)^{\frac{1}{n}}\left[2c^2u^2 - \frac{c(c+u)}{\tau}\Upsilon\right]$$

Figure 13:
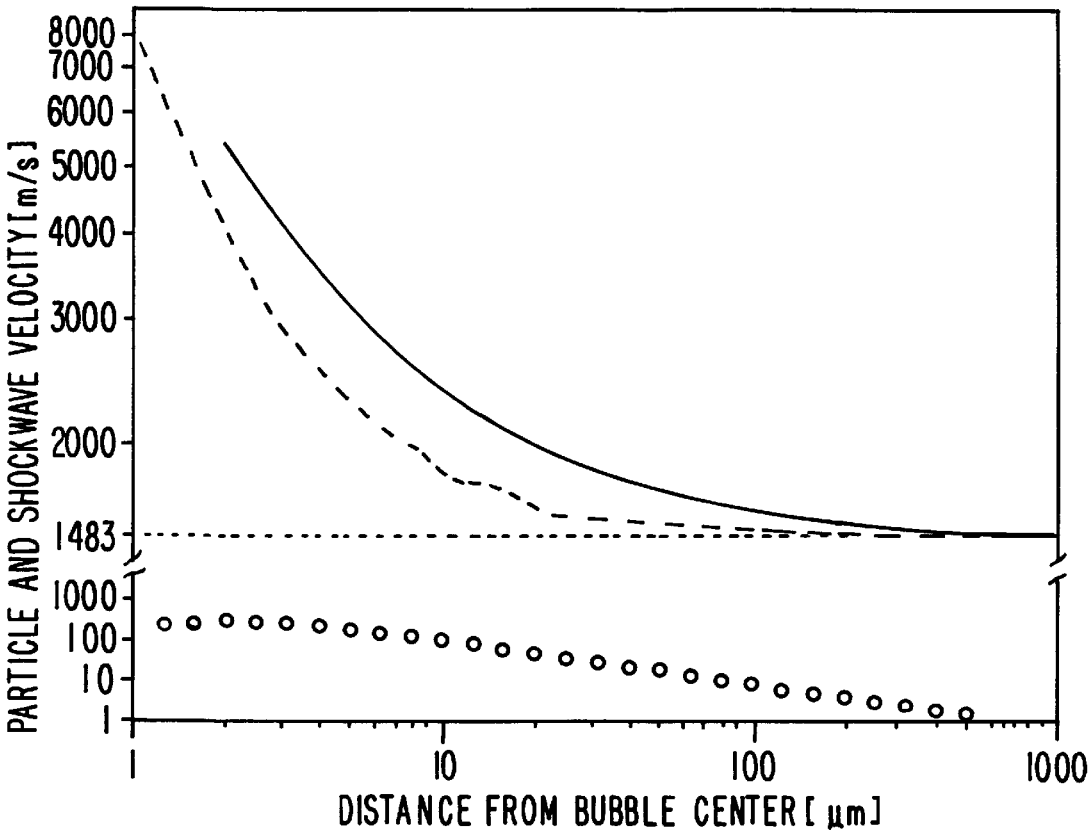
FIG. 13 is a mathematical plot of numerical calculations of a shock wave generated at collapse time of a bubble of 5 microns radius with an inset showing peak pressure that is traveling away from the bubble into the liquid.
Figure 13A:
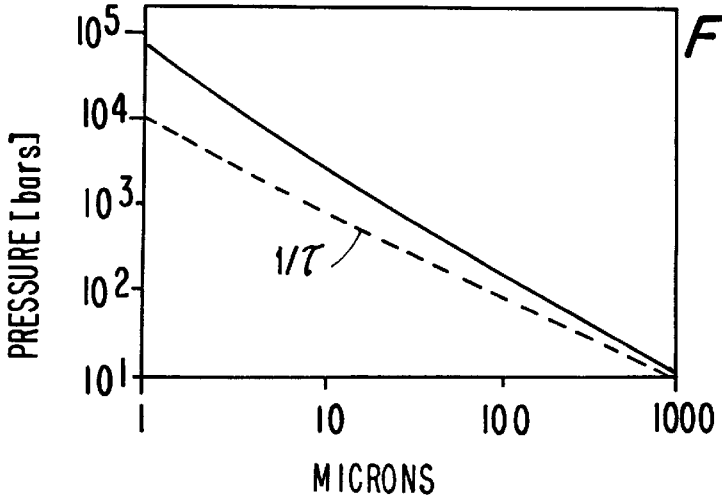

Solving the bubble equation, Equation 11 gives the initial values R, R (time average) H and u=R (time average) for each characteristic. Crossing characteristics in r-t space imply the generation of a shock. The exact position of the shock front can be obtained by equalization of the particle velocities in the hysteretic u-t curves. FIG. 13 shows the calculated shock wave velocity as a function of the distance from the bubble center. The maximal velocity of the pressure peak of approximately 8300 m/s decreases within the first hundred microns to the ambient sound velocity. For comparison with the experiment the mean velocity of the peak is shown in FIG. 13. The experimentally obtained short time average and mean velocities compare quite well to the numerical findings. The particle velocity in the model reaches a maximum value of 333 m/s. The inset in FIG. 13 shows the peak pressure of the shock as it travels away from the center. The maximum value of 73000 bars at 1 micron decays quickly with increasing distance, within 100 microns with a faster decay rate than the usual. Though these numbers may be somewhat overestimated due to model limitations, it is seen that within the first few m extreme conditions exist in the fluid. The greater dissipation close to the bubble may account for differences between our experimental results and previous inferences of the shock pressure from direct hydrophone measurements, which have yielded smaller values for the pressure. Using the shock wave as a microscope for the bubble position at collapse time, the time dependence and the position of the collapse have been measured for unstable SBSL. Unstable SBSL occurs at the upper parameter values of the driving pressure and ambient gas concentration: The ambient bubble radius grows until the bubble dynamics reaches an instability where bubble volume is rapidly lost. This cycle repeats itself on a slow time scale. Using rare events of double exposure at split-off time, the distance of the centers of two shock waves representing a bubble before and after the split-off can be used to calculate a lower bound of the bubble velocity due to the recoil of 0.5 m/s.

FIG. 13 shows numerical calculations of a shock wave generated at collapse time of a bubble of 5 microns ambient radius driven at 23.5 kHz and 1.45 bars. Shown are data for the pressure peak that is traveling away from the bubble into the liquid as a function of distance from the bubble center. Dashed line: velocity of the peak; solid line: extrapolated mean shock velocity; squares: particle velocity. The inset shows the calculated peak pressure in the shock as a function of distance from the bubble (solid line). The dotted line shows a 1/τ reference line for comparison.

Figure 14A:
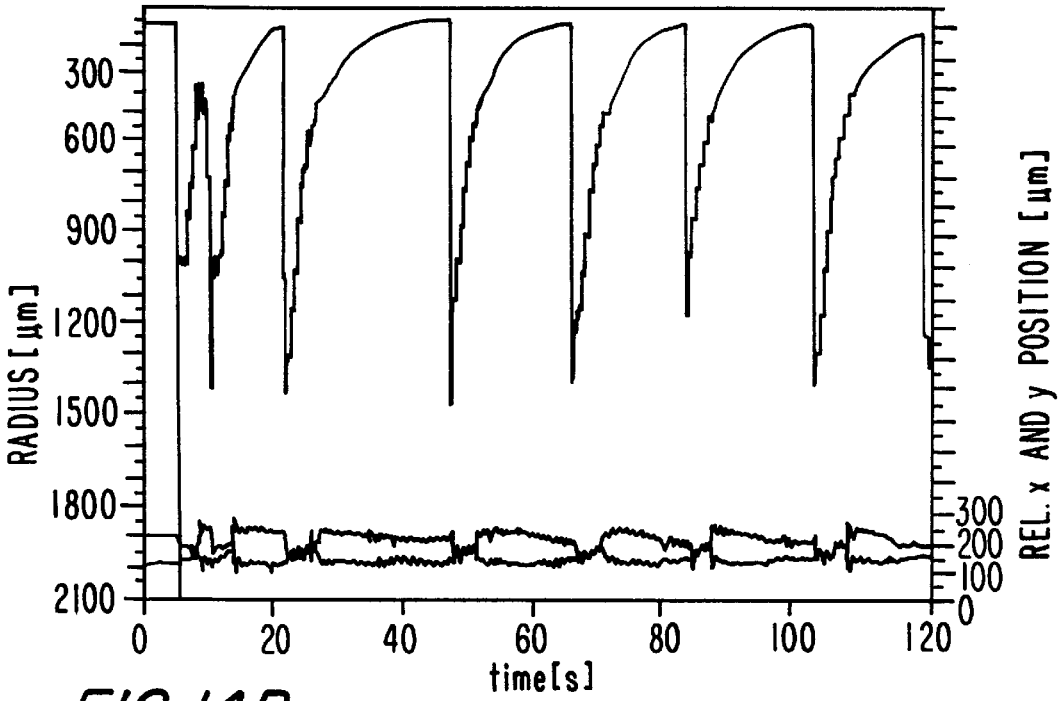
FIGS. 14A & 14B are mathematical plots of measured radii of shock waves and position of the center during unstable SBSL, with data have been digitized from images taken each 40 ms at a constant phase of the driving, wherein in 14A, the upper line shows the radii of shock waves as a function of time, as they change on a slow time scale and the lower two lines are relative x and y coordinates of the bubble at collapse and in FIG. 14B, a magnified portion of the first seconds of the plot of FIG. 14A, wherein spatial oscillations can be seen as the shock radii (and the ambient radius of the bubble) are changing at, e.g., t=8–9 s.
Figure 14B:
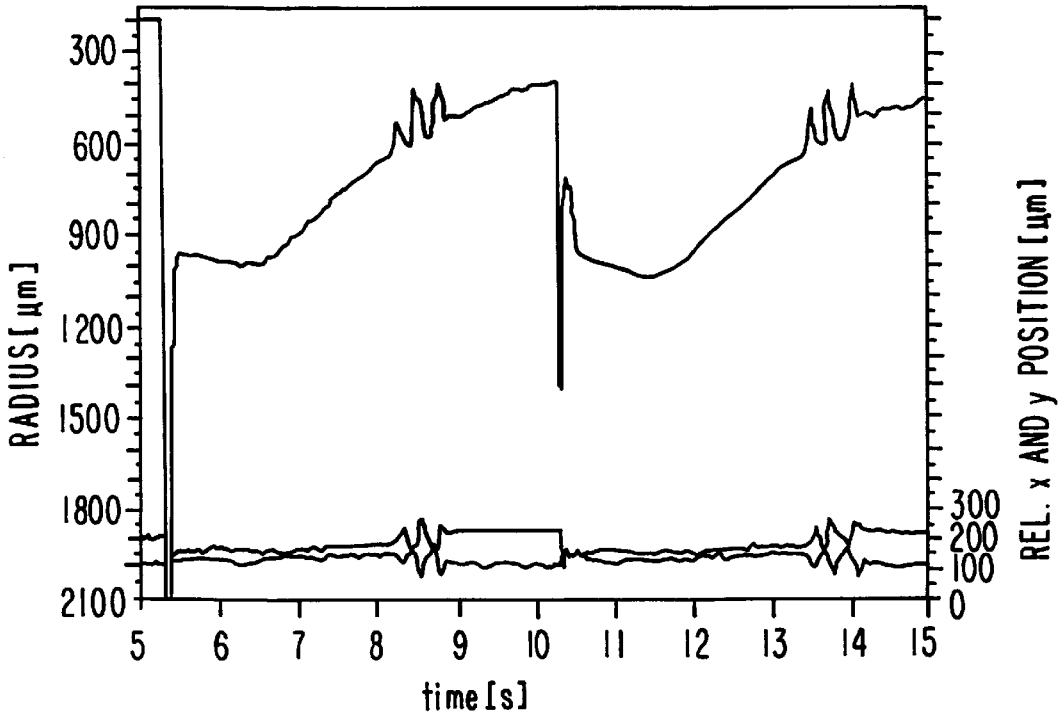

During unstable SBSL the bubble shows its dynamical behavior over a long range of its ambient radius as a parameter. FIG. 14 shows the radius of the shock wave and the bubble position at collapse time as a function of time. All experimental conditions were kept constant. It is seen that the bubble collapse does not occur at a constant phase any more. As the ambient bubble radius grows by diffusion, the collapse is shifted to later times. Because the illuminating flash occurs at a fixed phase of the driving signal some small time after the collapse, a later collapse decreases the time the shock front can travel outward until it is imaged. This way a larger ambient bubble radius shows up as a smaller shock radius. In FIG. 14*a* the recurrent process of growing on a slow time scale and a subsequent rapid decrease of ambient volume of the bubble is seen. At split-off the collapse time of the bubble is shifted by approximately 1 microsecond with respect to the driving phase. Calculations of collapse time vs bubble volume for SBSL-relevant bubble radii show (see also) that the bubble loses about one half of its volume. Most probably, multiple fragments (microbubbles) will be generated. So far microbubbles have been observed at the lower amplitude threshold of SBSL, where they have a slowly decreasing velocity of initially 3–4 mm/s, do not return to the bigger bubble, but dissolve within a few hundred microns within approximately 0.1 s. A closer look on a single cycle of FIG. 14 reveals that the growing phase has a peculiar fine structure. Immediately after microbubble split-off (e.g. at t=5.4, 10.4 s) the collapse is shifted to later times (smaller shock radii), reaching a slightly decreasing plateau until it finally increases. During each growing phase small bumps are seen (e.g. at t=8–9 s). Looking at the position of the bubble one sees a connection: Each time the phase bumps, the bubble moves discretely through space and finally settles. The explanation may be oscillation in different resonances, shock wave interaction or the acoustic field acting on the bubble is altered as it grows.

FIG. 14 shows measured radii of shock waves and position of the center during unstable SBSL. Data have been digitized from images taken each 40 ms at a constant phase of the driving. (a) The upper line shows the radii of shock waves as a function of time, as they change on a slow time scale. The lower two lines are relative x and y coordinates of the bubble at collapse. (b) Zoom into the first seconds of (a). Spatial oscillations are seen as the shock radii (and the ambient radius of the bubble) are changing at, e.g., t=8–9 s.

We have visualized the generation of shock waves from a sonoluminescing bubble for the first time. Resulting from the enormous pressure inside the bubble and the great amount of energy transported by the surrounding liquid, the shock front is shown to have a faster speed than the ambient sound velocity. If one calculates the change in the refractive index of water due to the theoretical local overpressure of 73 kbars, one arrives at a $\Delta n=0.23$, which is 70% of the change at an air/water interface. Therefore measurements of the minimal radius by Mie scattering together with statements about the exact timing of the flash with respect to the minimal radius should be done keeping this in mind as the shock wave builds a scattering layer around the bubble. We cannot conclude from our data whether the visualized shock in the liquid also consists of contributions of an hypothetical inner bubble shock that may be responsible for SBSL. The observed refocused shock can be shown to have an impact on the bubble dynamics. It would be interesting to see if exact positioning and control of the timing of the reflected shock wave can be used to increase SBSL intensity.

Boosting Sonoluminescence

By focusing ultrasonic waves of high intensity into a liquid, thousands of tiny bubbles appear. This process of breakup of the liquid is called acoustic cavitation. The bubbles begin to form a fractal structure that is dynamically changing in time. They also emit a loud chaotic sound because of their forced nonlinear oscillations in the sound field. The large mechanical forces on objects brought into contact with the bubbles enable the usage of cavitation in cleaning, particle destruction and chemistry. Marinesco and Trillat found that a photo plate in water could be fogged by ultrasound. This multi bubble sonoluminescence (MBSL) has been analyzed by many researchers, and a great amount of knowledge has been gained. The discovery of Gaitan that it is possible to drive a single stable bubble in a regime, where it emits light pulses of picosecond duration, called SBSL, has been encouraging scientists to explore the phenomenon and the associated effects with a multitude of experiments, theories and simulations. The experimental results show picosecond synchronicity, quasiperiodic and chaotic variability of interpulse times, a black body spectrum and mass transport stability. The theories to explain the source of SBSL range from hotspot, bremsstrahlung, collision induced radiation and corona discharges to non-classical light. Numerical simulations have been focusing on the bubble dynamics, behavior of the gas content, properties in magnetic fields and the stability of the bubble. However, the final answer concerning the nature of SBSL still remains open.

The amount of energy concentration from low energy acoustic sound waves to 3 eV photons raises the question, whether the effect can be up-scaled. In this paper, we report on experimental enhancement of SBSL light production by a bimodal excitation of the bubble oscillation. The experiment follows an idea stated in. We also present numerical simulations of multi-mode sound driving that reveal how multi-harmonic excitation can adapt to the highly nonlinear bubble oscillation in the sense of a strong collapse.

The experimental setup is as follows: An air bubble is trapped in a water filled cell consisting of two piezoceramic cylinders connected via a glass tube. The levitation cell ("Crum cell") is standing upright with a glass plate covering the lower end of the cell. The upper end remains open. A video camera pointing from the side allows for online monitoring of the experiment. The experiments were done with distilled and de-gassed water at room temperature and an ambient pressure of 1 atmosphere.

$$P_c(l)=P_1 \cos(2\pi f t)+P_2 \cos(2\pi 2 f t+\phi) \qquad \text{Equation 16}$$

The bimodal driving signal is produced by synchronized sine wave generators that allow to fix the amplitudes P1, P2, and the relative phase ø. Using a multi-frequency driving signal however is complicated by two facts. First the transducers have a complex transfer function and second the standing wave conditions at each frequency in the cell have to be obeyed. Therefore, multi-frequency driving results in space dependent phases and amplitude relations and thus in an effective sound signal ($P_c(\tau.z.l)$ with cylinder coordinates r, z of the levitation cell). To measure the amplitudes and relative phase that actually appear at the bubble position, a small hydrophone is used. The correct position is adjusted by first focusing the camera on the bubble and then inserting the hydrophone at the bubble site. The driving signal is digitally recorded and phases and amplitudes are recovered via a Fourier transform. The light flashes emitted at collapse are measured with a photomultiplier.

Levitating small oscillating bubbles of volume V(t) is non-zero gravity is possible through the interaction with the driving sound field $P_c(\tau.z,l)$ The time averaged primary Bjerknes force $$F_B=-(V(l)\nabla P_a(\tau,z,l)) \qquad \text{Equation 17}$$

can overcome the buoyancy force and attract the bubble to a fixed position in space. Weakly sinusoidally driven bubbles of equilibrium radius $R_0$ are trapped near a pressure antinode if they are driven below their linear resonance (Minnaert) frequency $$f_M=(2\pi R_0)^{-1}\sqrt{3\kappa p_0/\rho}\approx 3/R_0\ [Hz] \qquad \text{Equation 18}$$

for the experimental conditions used here (with polytropic exponent κ, ambient pressure $p_0$, and liquid density ρ). However, the situation is more complicated for strongly driven bubbles and also for multi-modal excitation, where the standing wave pattern in the resonator, the Bjerknes forces and thus the bubble position are changed by a variation of the sound signal parameters P1, P2, and ø. The bubble oscillation responds to the sound signal at the trapping site.

Figure 15:
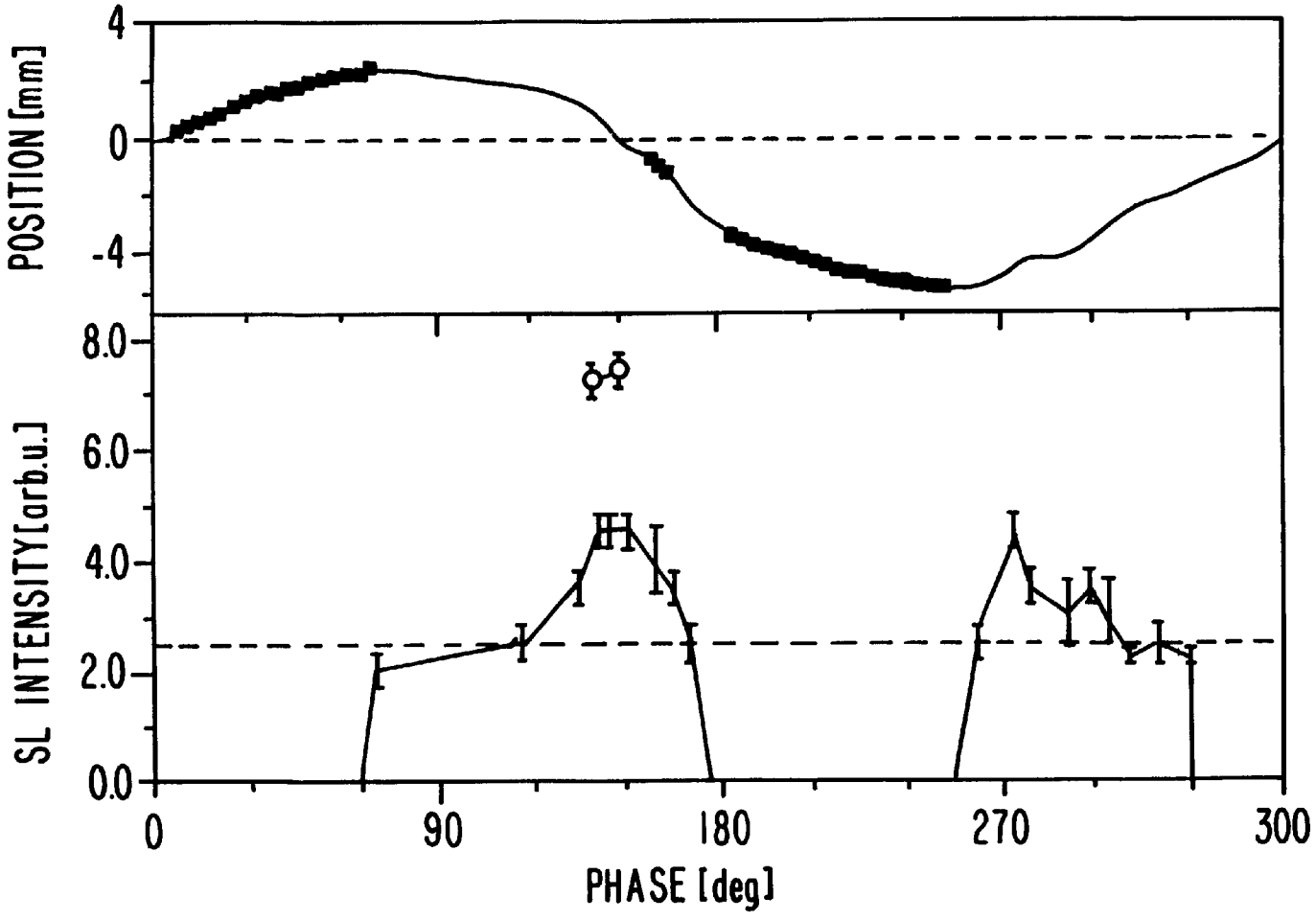
FIG. 15 is a mathematical plot of the bubble response for 2-mode driving as a function of the phase difference (in degrees) between the driving sinusoidal signal and its second harmonic, wherein the upper trance is the vertical position of the bubble and the thick dotted lines denote unstable bubble behavior, while the lower trace shows the corresponding photo current, with open circles showing the maximum SL intensity achieved, and the dashed line is the maximal photo current for pure sine-wave driving.

In the experiment, we proceeded in the following way: For fixed drive amplitudes $P_1$ and $P_2$, a bubble is injected into the fluid with a syringe. Once the bubble fixes itself spatially at a stable position, where the Bjerknes force equals the buoyancy force, the phase difference between the locked sine wave generators, one operating at f=23.4 kHz and the other at 2 f, is sequentially increased while the SL intensity and the bubble itself are monitored. FIG. 15 shows the SL intensity as a function of the phase difference for $P_1\approx 1.25$ bar, $P_2\approx 0.3$ bar. With increased phase difference two maxima appear in the light intensity. The dashed line indicates the maximum achievable SL intensity using single mode driving. This value is obtained shortly before and after the 2-mode experiment to allow direct comparison by keeping all other experimental conditions unchanged. It is seen, that the 2-mode driving yields 100% more SL intensity than the maximal single mode driving. By further increase of P1 and P2 at selected phases an intensity gain of 300% can be achieved, as shown by the open circles. Beyond that, the bubble gets destroyed.

FIG. 15 (upper) reveals, that with increased phase difference the bubble traverses vertically through stable and (surface) unstable regimes.

In FIG. 15, the bubble response for 2-mode driving as a function of the phase difference (in degrees) between the driving sinusoidal signal and its second harmonic. Upper: vertical position of the bubble. The thick dotted lines denote unstable bubble behavior. Lower: photo current. The open circles show the maximum SL intensity achieved. The dashed line is the maximal photo current for pure sine wave driving.

Numerical simulations have been carried out using the Gilmore model which describes the radial motion of a single bubble. The model includes the usual components of the RPNNP equation like surface tension and liquid viscosity $\mu$, and also the compressibility of the liquid to allow damping of the bubble motion by the shedding of shock waves.

$$\left(1-\frac{\dot{R}}{C}\right)R\ddot{R}+\frac{3}{2}\left(1-\frac{\dot{R}}{3C}\right)\dot{R}^2=\left(1+\frac{\dot{R}}{C}\right)H+\left(1+\frac{\dot{R}}{C}\right)\frac{R}{C}\frac{dH}{dl} \quad \text{Equation 19}$$

$$H=\int_{p_\infty}^{p(R)}\frac{dp}{\rho},\ \frac{p(R,\dot{R})+B}{p_0+B}=\left\{\frac{\rho}{\rho_0}\right\}^n, \quad \text{Equation 20, 21, 22}$$

$$c\Big|_{r\sim R}=C=\sqrt{\frac{dp}{d\rho}}\Big|_{r\sim R}=\sqrt{c_e^2+(n-1)H},$$

$$p(R,\dot{R})=\left(p_0=\frac{2\sigma}{R_0}\right)\left(\frac{R_0^3-a^3}{R^3-a^3}\right)-\frac{2\sigma}{R}-\frac{4\mu}{R}\dot{R}.$$

R is the bubble radius, $R_0$=5 $\mu$m it equilibrium radius, C, ρ, and p are the speed of sound in the liquid, its density, and the pressure at the bubble wall, respectively. H is the enthalpy of the liquid. Parameters were set to $c_0$=1500 m/s, $\rho_0$=998 kg/m, $p_0$=1 bar, κ=4/3, σ=0.0725 N/m, $\mu$=0.001 Ns/m, n=7, B=3000 bar, a=$R_0$/8.54 is a hard-core van der Waals-term. The pressure at infinity includes the multi-modal driving pressure:

$$p_\infty=p_0+P_e(l)=\sum_{m=1}^{M}P_m\cos(2\pi mfl+\phi_m). \quad \text{Equation 23}$$

First, the driving sound signal that would lead to the most violent collapse was calculated, indicated by the smallest minimum radius during a bubble oscillation cycle using the above equation. The search for suitable pressures $P_m$ and phases $\phi_m$ was carried out by a heuristical optimization algorithm with the boundary condition of a constant driving signal power, i.e., $$P_c^2=\Sigma_{m-1}^{M}P_m^2=\text{constant} \quad \text{Equation 24}$$

$P_c$ was fixed to 1.3 bar and the driving frequency was the same as in the experiment. Comparing equal power signals is convenient, because the power stays constant upon phase changes, making it possible to compare numerics and experiments.

Figure 16:
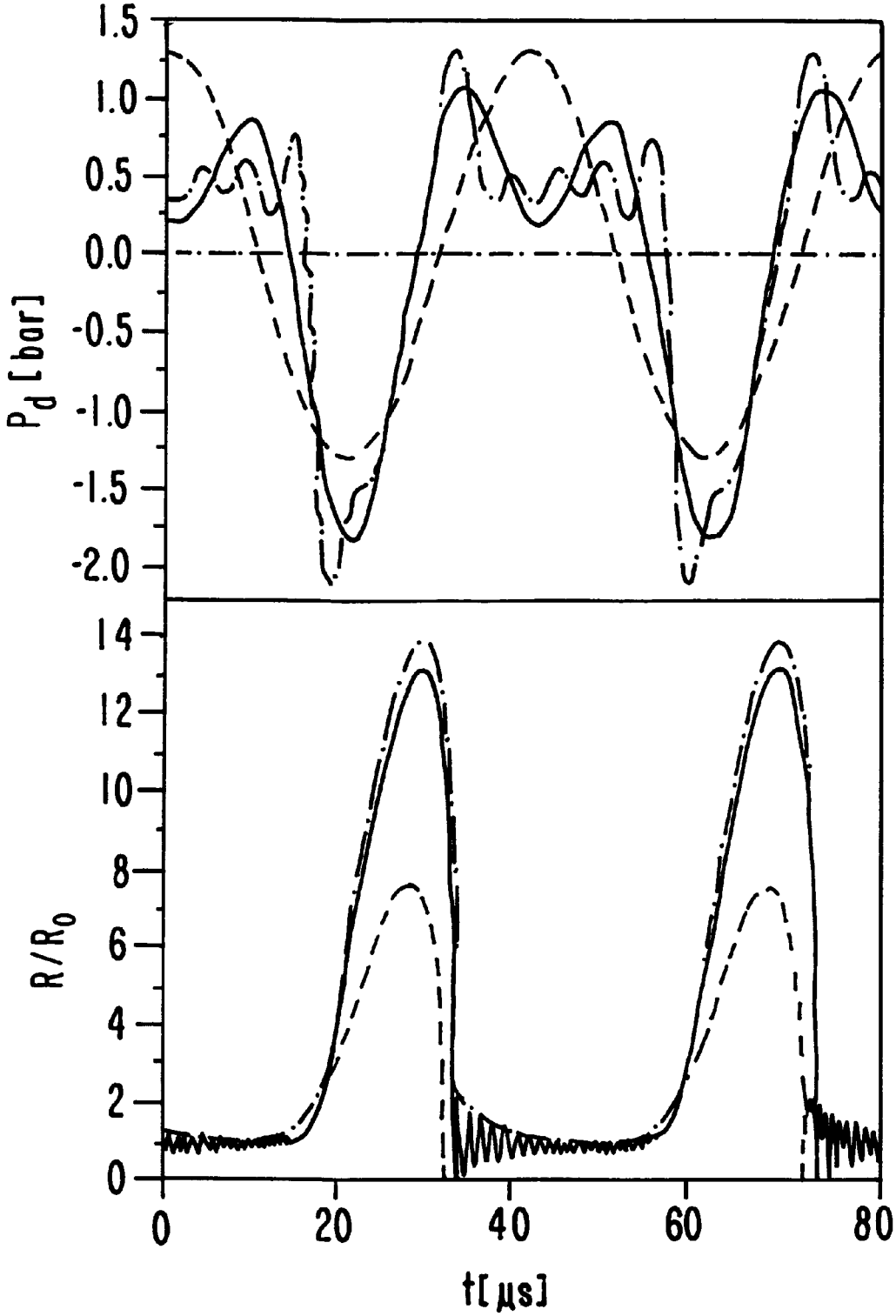
FIG. 16 are mathematical plots of time series of the driving (top) and the radius of calculated bubble collapses (bottom) for single (dashed) and optimized multi-mode driving signals (2-mode: line, 8-mode: dotted)
Figure 17B:
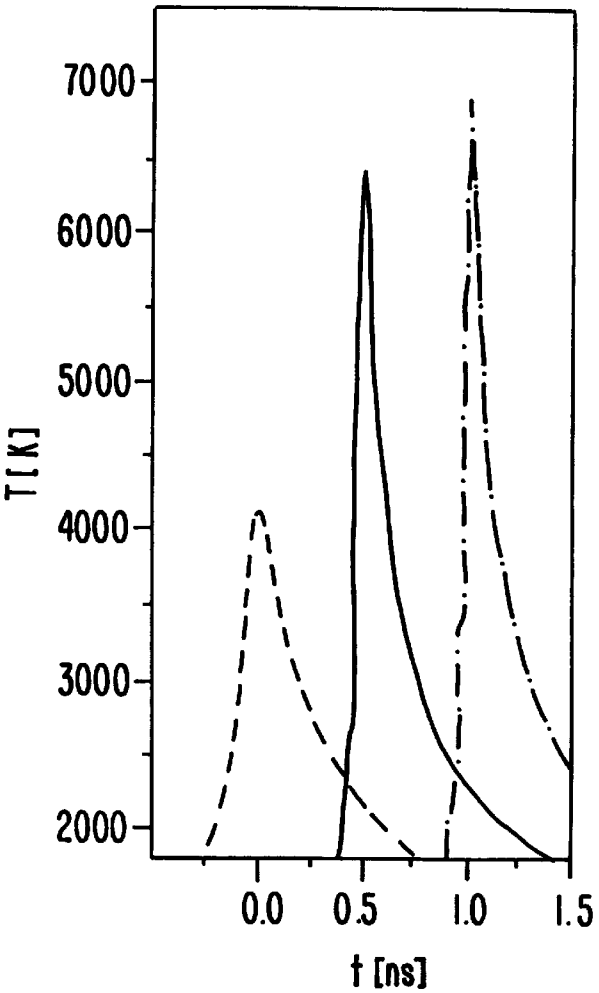
FIG. 17 is a magnified portion of the mathematical plot of the first collapses of FIG. 15, with the time axis is shifted so that the collapses take place at 0, 0.5, and 1 ns, respectively, showing the curves for 1-mode (dashed), optimized 2-mode (line) and optimized 8-mode (dotted) driving, wherein the time series of the bubble collapses exhibit a decrease in minimum radius (left) and increase in the adiabatically calculated temperature (right) as a function of the number of modes in the driving sound, and including an indication of the van der Waals hard core, shown by the horizontal line in the left graph.
Figure 17A:
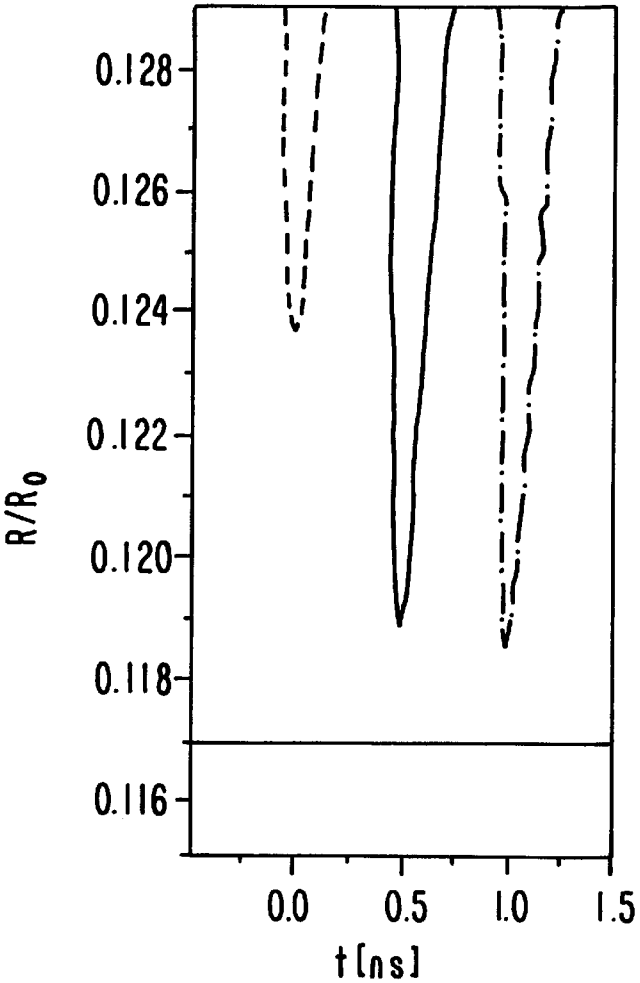

FIG. 16 shows the driving pressure and the bubble response of different driving signals. A strong increase in the maximum radius can be seen already by adding just the second harmonic to a sine wave. The numerically computed optimal phase difference is 166.4 degrees and the individual amplitudes are $P_1$=1.026 bar and $P_2$=0.798 bar. The radius and the adiabatically calculated temperature around the collapses are shown in FIG. 17. It is seen, that the bubble radius at collapse is decreased by a large amount and is approaching the van der Waals hard core already for the 2-mode driving. Also the maximum temperatures almost double. The higher mode driving signals are better adapted to the nonlinear bubble oscillation than the sine signal: they show a deeper rarefaction phase before collapse, followed by a more rapid rise to the compression phase during collapse.

In FIG. 16, time series of the driving (top) and the radius of calculated bubble collapses (bottom) for single (dashed) and optimized multi-mode driving signals (2-mode: line, 8-mode: dotted).

The calculations for optimal 8-mode driving exhibit only small additional gain compared to bimodal driving. Because of the increased difficulties regarding the spatial stability of bubbles in the resulting complicated sound field, an 8-mode driving may not be worth being considered experimentally. Though 2-mode driving is an early truncation of a series expansion, one sees, that already this approximation shows a trend for a more intense driving of this nonlinear system.

The optimal results are located on a single broad plateau in parameter space. This is in contrast to the experimental finding of two maxima. To understand the reason of this obvious discrepancy, the bubble model equation, Equation 19 has been integrated numerically along with the primary Bjerknes equation, Equation 17 and the buoyancy forces to examine spatial dependencies. This is also motivated by the observation, that the vertical position of the bubble is altered when the phase is changed (FIG. 15 upper). The change of position leads to different effective excitation amplitudes for f and 2f and thus to a more complex scenario. The system of equations is integrated using the spatially dependent driving force $$P_c(l)=P_1\cos(2\pi fl)\cos(k/2z)+P_2\cos(2\pi 2fl+\phi)\cos(2kz-\pi/2) \quad \text{Equation 25}$$

Figure 18:
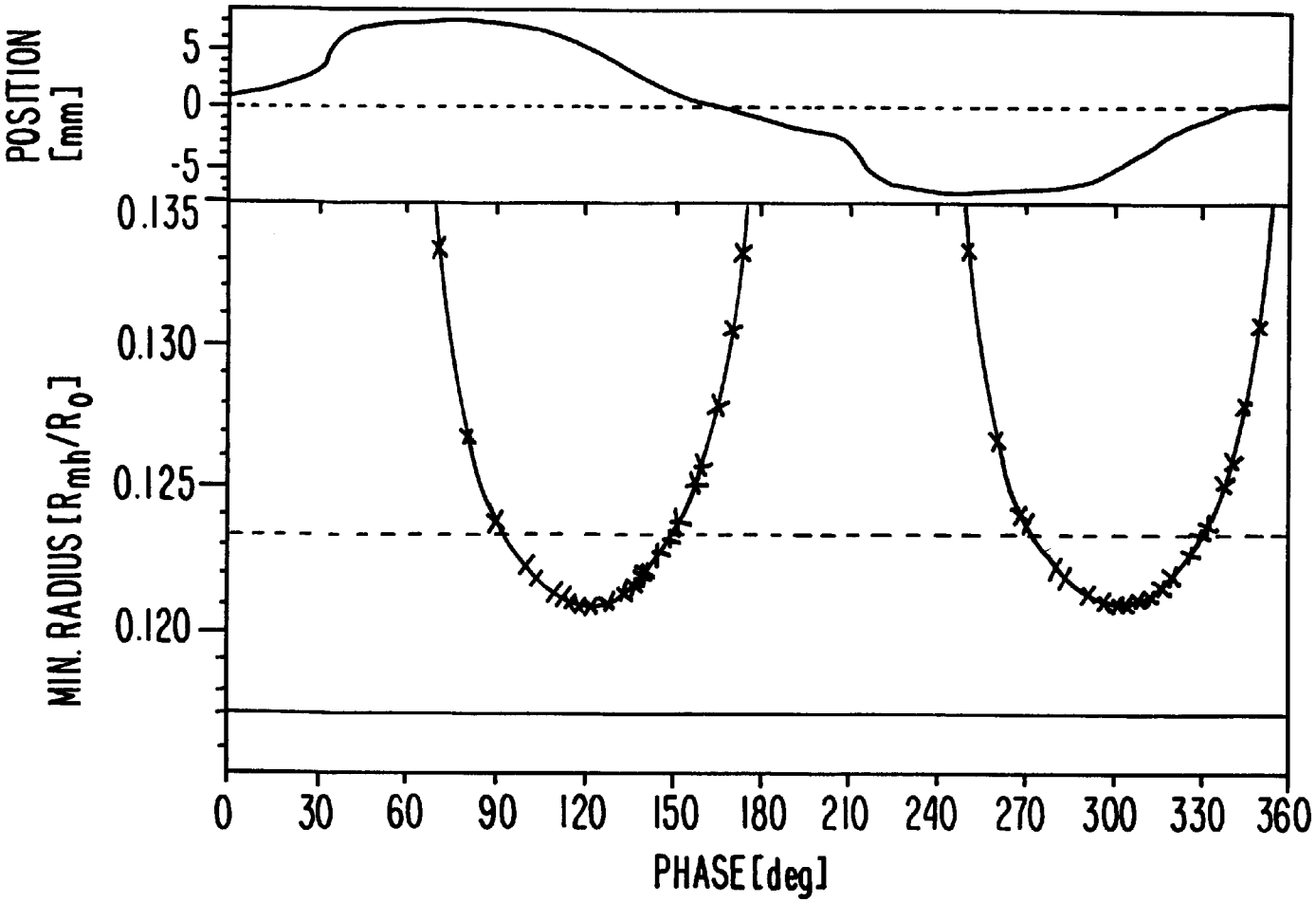
FIG. 18 is a mathematical plot of the calculated vertical bubble position (upper) and resulting minimum radius (lower) as a function of the phase difference for double harmonic driving of a bubble, wherein the dashed line in the lower plot is the minimum radius for single frequency driving with the same power, and the solid straight line is a reference to the van der Waals hard core.

(k is the acoustic wavenumber 2πf/c0, $P_1$=1.25 bar $P_2$=0.357 bar, f=23.4 kHz). The spatial modes are approximately the same as the experimental ones, which have been measured with a needle hydrophone. The points in vertical z-space where the Bjerknes force vanishes and the stability criterion is met represent the position of the bubble. The resulting minimum radii are shown in FIG. 18. Comparing this with the experimental results in FIG. 14 shows a very close agreement.

In FIG. 17, an expanded view is shown of the first collapses of FIG. 15. Shown are the curves for 1-mode (dashed), optimized 2-mode (line) and optimized 8-mode (dotted) driving. The time series of the bubble collapses exhibit a decrease in minimum radius (left) and increase in the adiabatically calculated temperature (right) as a function of the number of modes in the driving sound. The minimum radius comes very close to the van der Waals hard core, shown by the horizontal line in the left graph. The time axis is shifted so that the collapses take place at 0, 0.5, and 1 ns, respectively.

FIG. 18 provides numerically calculated vertical bubble position (upper) and resulting minimum radius (lower) as a function of the phase difference for double harmonic driving of a bubble. The dashed line in the lower plot is the minimum radius for single frequency driving with the same power. The solid straight line is the van der Waals hard core.

The almost sinusoidal variation of the position of the bubble gives rise to two minima of the minimal radius/phase dependence. Each of these minima is smaller than the one of the single mode driving. The minima coincide with the experimental observation of increased SL intensity. The slight asymmetry in the experiment can be described by the difference in acoustic impedance of the glass bottom and the open top of the cell. Also, imperfect standing waves may lead to small travelling components in the experimental driving. Changing the amplitude ratio of the driving signal closer to unity while keeping the power constant results in a complex scenario of stable bubble positions and effective drivings including hysteretic jumps.

In summary, we have shown that a bimodal sound excitation can enhance light production of SBSL. Though spatial modes play a crucial role in double harmonic driving, it increased the photo current to a gain of maximally 300% compared to sine excitation. We suppose that multi-frequency driving can shift the bubble oscillation to a regime of strong stable SBSL which is not reachable by pure harmonic driving. Numerical simulations of an acoustically driven bubble including Bjerknes and buoyancy forces show that the increased SBSL light intensity is caused by a larger compression. To give quantitative estimates, however, elaborate models have to be considered that include gas dynamic equations for the interior of the bubble and thus can model the shedding of a shock wave inside a bubble.

Other methods have been proposed to increase the violence of bubble collapses. E.g., calculations for thermonuclear D—D fusion in D O within this context have been done using a large pressure pulse superimposed on a sine wave. However, whether advanced forcing by higher modes is large enough to achieve a reasonable neutron production rate is an open question. Apart from sonoluminescence, the increase of cavitation strength by means of optimized multi-harmonic sound signals can also be of use in the context of sonochemistry and related areas, where higher reaction rates could be induced.

Modifications and substitutions by one of ordinary skill in the art are within the scope of the present invention which is limited only by the claims, which follow.

What is claimed is:

1. A fluid pump, comprising:

a cylindrical transducer providing acoustic emissions along an interior aperture thereof in response to electrical excitation thereof;

an interior transducer disposed within said interior aperture having acoustic emissions along the interior aperture thereof in response to electrical excitation thereof; and a chamber for containing a fluid between said cylindrical transducer and said interior transducer, having a fluid inlet and a fluid exit, wherein fluid flow between said inlet and said exit is selectively provided according to the electrical excitation of said cylindrical transducer and said interior transducer.

2. The method of claim 8, further including the step of providing electrical excitation to at least one of an outer cylindrical and an interior acoustic transducer for creating one of a pressure and flow gradient, and establish moving standing waves between said cylindrical transducer and said interior transducer.

3. The fluid pump of claim 1, further comprising a plurality of cylindrical transducers being axially aligned and a plurality of interior transducers being axially aligned.

4. The method of claim 8, further comprising the steps of providing a plurality of cylindrical transducers being axially aligned and a plurality of interior transducers being axially aligned, and providing electrical excitation to said plurality of cylindrical and interior transducers at selective relative phase differences.

5. The fluid pump of claim 3, wherein said cylindrical transducers and interior transducers are each electrically and mechanically isolated from other axially disposed cylindrical and axially disposed interior transducers.

6. The fluid pump of claim 1, wherein said chamber further comprises a volumetric region at one end of said cylindrical transducer, wherein increased pressure to fluid within said volumetric region is selectively provided according to the electrical excitation of said cylindrical transducer and said interior transducer.

7. The fluid pump of claim 6, further comprising a valve means disposed on said volumetric region to provide selective fluid flow therethrough.

8. A method of providing fluid motion along a path, comprising the steps of:

providing an outer annular acoustic energy along said path; and providing an inner annular acoustic energy along said path, wherein said inner and outer annular acoustic energies are selectively aligned in frequency and phase to produce said fluid motion.

9. The method of claim 8, wherein said frequency and phase of said inner and outer annular acoustic energies are selected to provide moving standing waves along said path.

10. A radiant energy source, comprising:

a cylindrical transducer providing acoustic emissions along an interior aperture thereof in response to electrical excitation thereof;

an interior transducer disposed within said interior aperture having providing acoustic emissions along the interior aperture thereof in response to electrical excitation thereof;

a chamber for containing a fluid between said cylindrical transducer and said interior transducer, having an additional volumetric region at one end of said cylindrical transducer, wherein increased pressure to fluid within said volumetric region is selectively provided according to the electrical excitation of said cylindrical transducer and said interior transducer, resulting in the generation of sonoluminescent radiation; and a window disposed on said chamber to provide an exit of said sonoluminescent radiation from said chamber.

* * * * *